US006120366A

United States Patent [19]

Lin et al.

[11] Patent Number: 6,120,366

[45] Date of Patent: Sep. 19, 2000

[54] CHEMICAL-MECHANICAL POLISHING PAD

[75] Inventors: Juen-Kuen Lin, Kaohsiung; Chien-Hsin Lai, Kaohsiung Hsien; Peng-Yih Peng, Hsinchu Hsien; Edward Yang, Kaohsiung; Kun-Lin Wu, Taichung; Fu-Yang Yu, Hsinchu, all of Taiwan

[73] Assignee: United Microelectronics Corp., Hsinchu, Taiwan

[21] Appl. No.: 09/225,367

[22] Filed: Jan. 4, 1999

[51] Int. Cl.[7] ..... B23F 21/03; B24B 1/00

[52] U.S. Cl. ..... 451/550; 451/41

[58] Field of Search ..... 451/41, 285, 288, 451/525, 526, 527, 530, 539, 921

[56] References Cited

U.S. PATENT DOCUMENTS

| | | | |
|---|---|---|---|
| 5,645,469 | 7/1997 | Burke et al. | 451/527 |
| 5,782,682 | 7/1998 | Han et al. | 451/527 |
| 5,888,121 | 3/1999 | Kirchner et al. | 451/527 |
| 5,921,855 | 7/1999 | Osterheld et al. | 451/527 |
| 5,984,769 | 11/1999 | Bennett et al. | 451/527 |

FOREIGN PATENT DOCUMENTS

| | | |
|---|---|---|
| 0050233 | 4/1982 | European Pat. Off. . |
| 407407 | 3/1934 | United Kingdom . |
| 671961 | 5/1952 | United Kingdom . |
| 1582366 | 1/1981 | United Kingdom . |
| WO 98/12020 | 3/1998 | WIPO . |

*Primary Examiner*—Rodney A. Butler

[57] ABSTRACT

The invention provides a chemical-mechanical polishing pad, which includes a plurality of annular grooves and a plurality of streamline grooves designed according to principles of the hydrodynamics. The streamline grooves of polishing pad are designed according to flow equations derived from source flow and vortex flow, and the streamline grooves of polishing pad uniformly distribute the slurry on the polishing pad. An angle and a depth of the streamline groove, which are calculated by boundary layer effect of the streamline groove function, are used to design an optimum structure for polishing pad.

10 Claims, 4 Drawing Sheets

CHEMICAL-MECHANICAL POLISHING PAD

BACKGROUND OF THE INVENTION

1. Field of the Invention

The present invention relates to chemical-mechanical polishing. More particularly, the present invention relates to a chemical-mechanical polishing pad.

2. Description of the Related Art

For very large scale integration (VLSI) or even ultra large scale integration (ULSI), chemical-mechanical polishing is the only technique that provides global planarization.

A general CMP apparatus is shown in FIGS. 1A through 1C. FIGS. 1A and 1B are respective side and top views showing a conventional chemical-mechanical polishing machine. Referring to FIG. 1A and FIG. 1B, a conventional chemical-mechanical polisher comprises a polishing table 10, a polishing pad 12 on the polishing table 10 and a polishing head 14 on the polishing table 10. During polishing, the polishing head 14 is used to hold the back of wafer 16. A duct 17 carries the slurry 18 to the polishing pad 12, and polishing is performed by spinning the polishing head 14 to remove uneven layers over the surface of the wafer 16.

FIG. 1C is schematic cross-sectional view showing the structure of polishing head 14 according to FIG. 1A. An air chamber 20 is at the top of the polishing head 14. The air chamber 20 exerts pressure on a wafer carrier 22 to bring the wafer 16 into close contact with the polishing pad 12. The wafer carrier 22 firmly holds the wafer 16 to enhance polishing performance. A wafer ring 24 underlies the wafer carrier 22 and surrounds the wafer 16, so that the wafer 16 is fixed in place by the wafer ring 24. Additionally, an insert pad (not shown) is provided between the wafer carrier 22 and the wafer 16.

FIG. 2 is schematic, top view showing the polishing pad 12 according to FIG. 1B. Referring to FIG. 2, the slurry 18 easily conglomerates in annular grooves around center as the duct 17 carries the slurry 18 to the polishing pad 12. This phenomenon makes it difficult for the slurry 18 to flow into the polishing head 14; therefore there is not enough slurry 18 in the polishing head 14. The uneven distribution of slurry 18 affects uniformity and degree of planarization of the wafer 16 while polishing is performed.

SUMMARY OF THE INVENTION

Accordingly, the present invention provides a chemical-mechanical polishing pad designed according to principles of hydrodynamics. A design pattern for streamline grooves on the chemical-mechanical polishing pad according to flow equations derived from source flow and vortex flow is provided. The streamline grooves of the chemical-mechanical polishing pad can uniformly distribute the slurry to enhance polishing performance and attain a high degree of planarization.

To achieve these and other advantages and in accordance with the purpose of the invention, as embodied and broadly described herein, the invention provides a chemical-mechanical polishing pad which includes a plurality of annular grooves and a plurality of streamline grooves; the streamline grooves are designed according to principles of hydrodynamics. The streamline grooves on the polishing pad are designed by flow equations derives from source flow and vortex flow; the source flow and the vortex flow are generated while the slurry flows on the polishing pad. The streamline grooves in the polishing pad uniformly distribute the slurry on the polishing pad. An angle of attack and a depth of streamline groove, which are calculated by a boundary layer effect on the streamline groove function, are further used to design an optimum structure for a polishing pad.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1A:
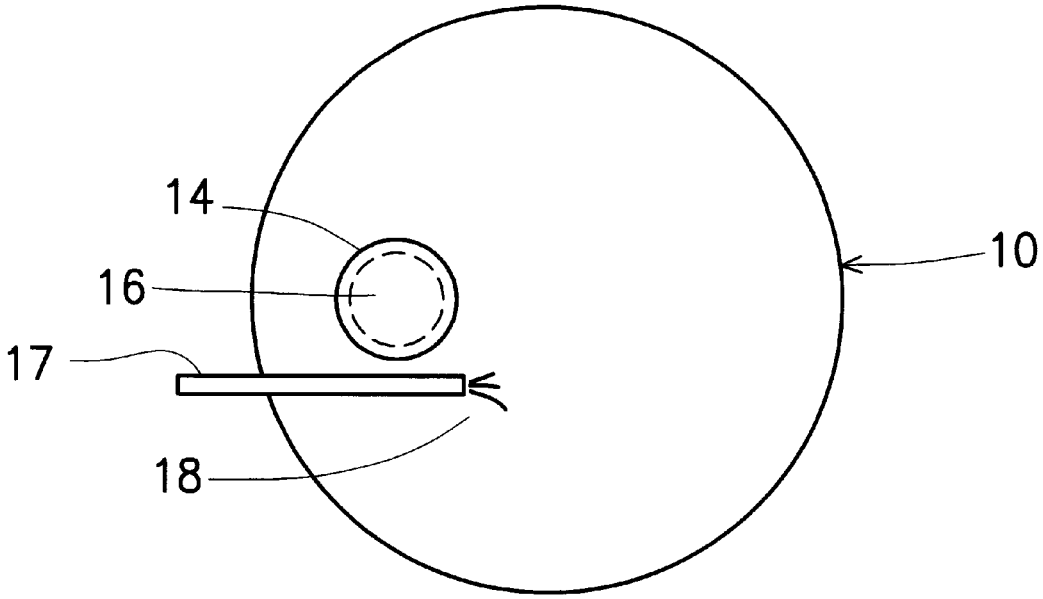
FIG. 1A (PRIOR ART)
FIG. 1A is schematic, top view showing the structure of a chemical-mechanical polishing machine.
Figure 1B:
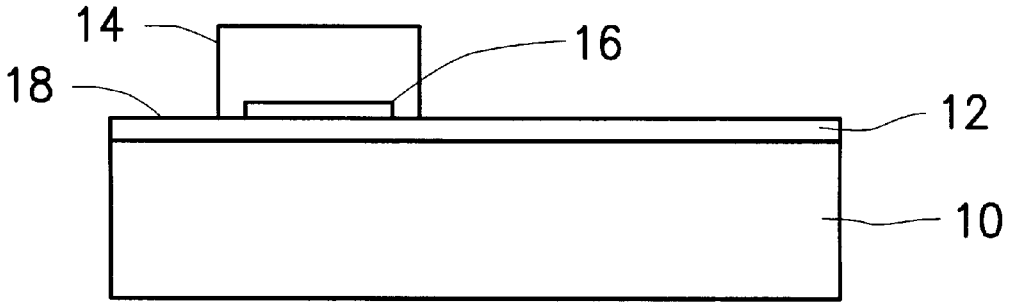
FIG. 1B (PRIOR ART)
FIG. 1B is schematic, side view showing the structure of a chemical-mechanical polishing machine.
Figure 1C:
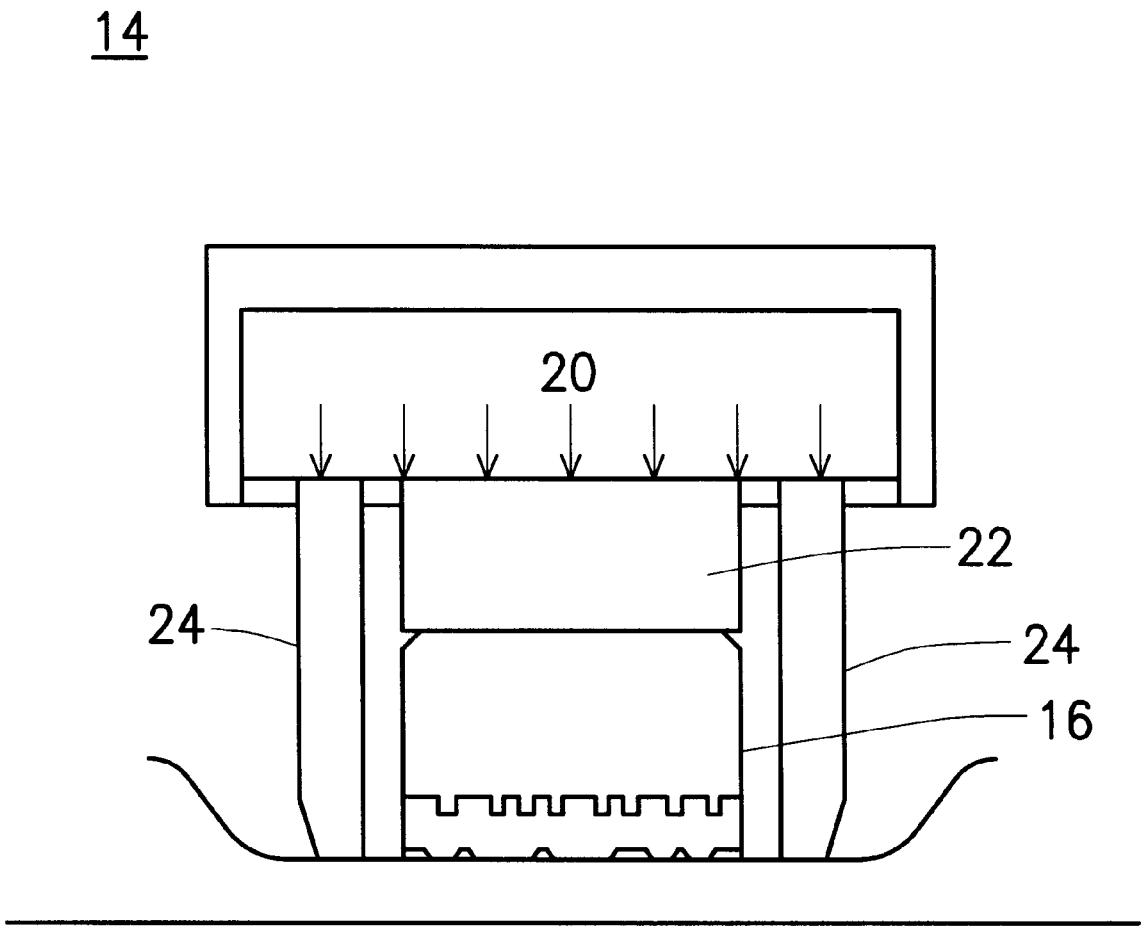
FIG. 1C (PRIOR ART)
FIG. 1C is schematic, cross-sectional showing the structure of polishing head 14 according to FIG. 1A.
Figure 2:
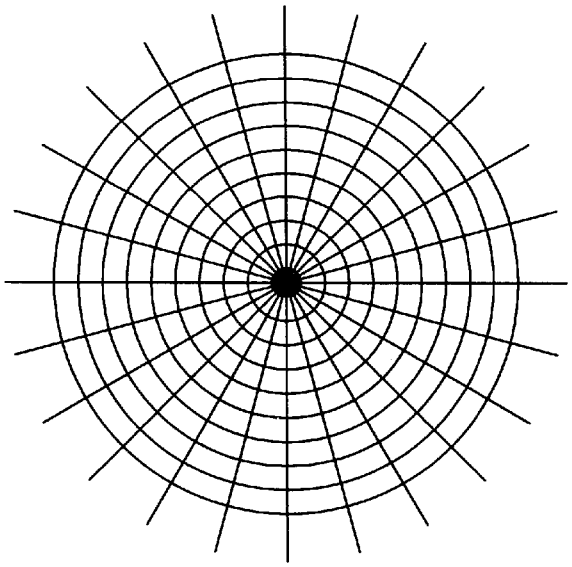
FIG. 2 (PRIOR ART)
FIG. 2 is schematic, top view showing the polishing pad 12 according to FIG. 1B.

Reference will now be made in detail to the present preferred embodiments of the invention, examples of which are illustrated in the accompanying drawings. Wherever possible, the same reference numbers are used in the drawings and the description to refer to the same or like parts.

The direction of slurry flow includes source flow and vortex flow, which can be described by equation (1):

$$\Psi = m\cdot\theta + k\cdot ln(r), \tag{1}$$

where $\Psi$ is a streamline function, m is an intensity constant for source flow, k is an intensity constant for vortex flow, ln is a natural logarithm, and r, $\theta$ and z are coordinate parameters.

$$\Gamma = \int v\cdot cos\ \alpha ds = 2\pi\cdot k, \tag{2}$$

where $\Gamma$ is fluid circulation.

Therefore, according to Eq. (1), a streamline groove function is obtained:

$$r = C_1\cdot e^{-m\theta/k}, \text{ and } C_1 = \text{constant} = e^{\Psi/k}, \tag{3}$$

where e is exponential. According to Eq. (3), a design pattern for streamline grooves for slurry is obtained.

A design pattern of the streamline grooves in the polishing pad for slurry is obtained from streamline function $\Psi = m\cdot\theta + k\cdot\ln(r)$. A polishing pad is designed according to an optimized result for the pattern of the streamline grooves, so that the grooves can optimize slurry flow direction distribution and uniformly distribute the slurry under the polishing head. The effect of polishing and the degree of planarization can be effectively improved.

Figure 3:
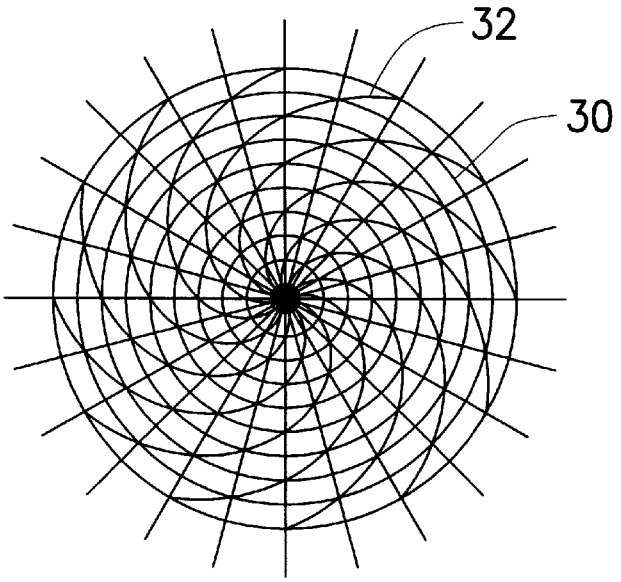
FIG. 3 is schematic, top view showing the chemical-mechanical polishing pad according to the preferred embodiment of this invention.

FIG. 3 is schematic, top view showing the chemical-mechanical polishing pad according to the preferred embodiment of this invention. Referring to FIG. 3, a polishing pad having primary annular grooves 30 and streamline grooves 32 designed according to principles of hydrodynamics is provided.

Moreover, if a boundary layer effect is further considered, the streamline groove function described above can be used to compute a best angle of attack and depth of streamline groove, so that the optimum structure for a polishing pad is obtained. A set of equations:

$$u\frac{\partial u}{\partial r}-\frac{v^2}{r}+w\frac{\partial u}{\partial z}=-\frac{1}{\rho}\frac{\partial P}{\partial r}+v\left[\frac{\partial^2 u}{\partial r^2}+\frac{\partial}{\partial r}\left(\frac{u}{r}\right)+\frac{\partial^2 u}{\partial z^2}\right]; \tag{4}$$

$$u\frac{\partial v}{\partial r}+\frac{uv}{r}+w\frac{\partial v}{\partial z}=v\left[\frac{\partial^2 v}{\partial r^2}+\frac{\partial}{\partial r}\left(\frac{v}{r}\right)+\frac{\partial^2 v}{\partial z^2}\right]; \text{ and} \tag{5}$$

$$u\frac{\partial w}{\partial r}+w\frac{\partial w}{\partial z}=-\frac{1}{\rho}\frac{\partial P}{\partial z}+v\left[\frac{\partial^2 w}{\partial r^2}+\frac{1}{r}\left(\frac{\partial w}{\partial r}\right)+\frac{\partial^2 w}{\partial z^2}\right], \tag{6}$$

are considered where equations (4), (5) and (6) are Navier-Stokes equations. u, v and w are respectively velocity for the r, θ and z components, ρ is density of slurry, ν is dynamic viscosity and p is pressure. The boundary conditions are:

z=0, u=0, v=−ωr, w=0; and z=∞, u=0, v=0, where ω is angular velocity.

A formula shown in Eq. (7), $$\tau_\omega\cdot\sin\theta drds=\rho\cdot r\cdot\omega^2\cdot\delta drds, \tag{7}$$

is also used.

The following equations (8) and (9):

$$\xi=z/\delta=z\sqrt{\frac{\omega}{\nu}}, \tag{8}$$

$$u=\omega\cdot r\cdot F(\xi),\ v=\omega\cdot r\cdot G(\xi),\ w=\sqrt{\omega\cdot\nu}\cdot H(\xi),$$

$$P=\rho\cdot\nu\cdot\omega\cdot P(\xi), \tag{9}$$

where τω is viscosity, δ is fluid layer thickness are applied for variable transformation. According to the Eqs. (4), (5), (6), (7), (8), (9), the following equations can be obtained:

$$2F+H'=0,\ F^2+F'\cdot H-G^2-F''=0,\ 2F\cdot G+H\cdot G'-G''=0,\ P'+H\cdot H'-H''=0, \tag{10}$$

which boundary conduction are:

ξ=0, F=0, G=−1, H=0, P=0; and

ξ=∞, F=0, G=0.

The equation of original angle of attack of the streamline groove is also used:

$$\tan\phi_0=-\left(\frac{\frac{\partial u}{\partial z}}{\frac{\partial v}{\partial z}}\right)_{z=0}=-\frac{F'(0)}{G'(0)} \tag{11}$$

Figure 4:
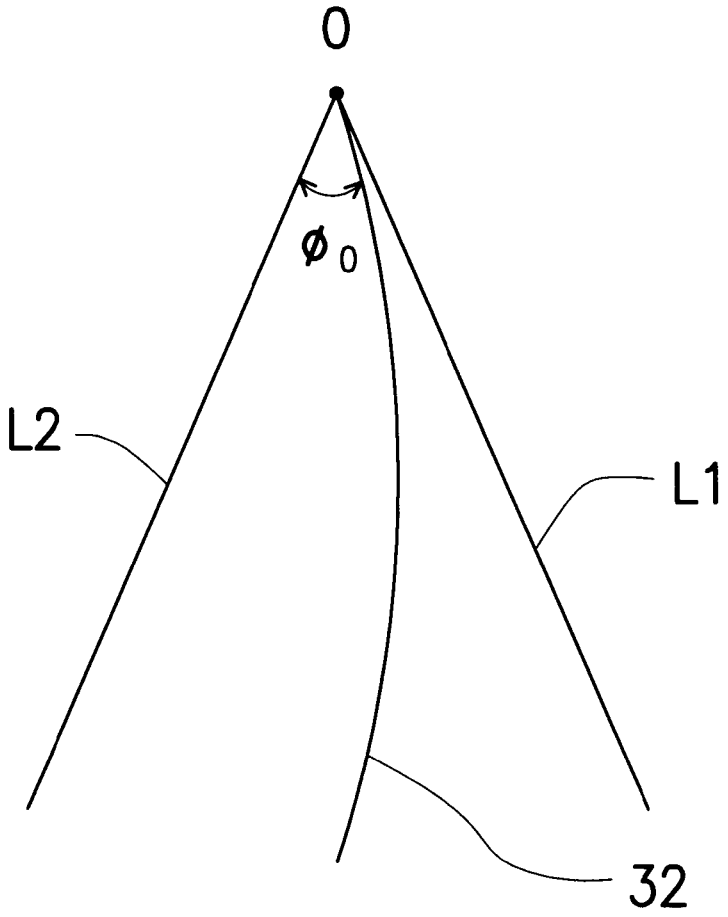
FIG. 4 is schematic, showing an original angle of streamline groove of polishing pad according to the preferred embodiment of this invention.

FIG. 4 is schematic representation of an original angle of attack of streamline groove in polishing pad according to the preferred embodiment of this invention. Referring to FIG. 4, an angle between the streamline groove 32 which is tangent to L1 at center 0 and L2, which is opposite to streamline groove 32, is the original angle of attack of streamline groove $\phi_0$.

(1) The present invention provides a chemical-mechanical polishing pad designed according to principles of hydrodynamics. Streamline grooves in the chemical-mechanical polishing pad can uniformly distribute the slurry to enhance polishing and attain a high degree of planarization while polishing is performed.

(2) The invention provides an angle of attack and a depth of streamline groove calculated by boundary layer effect are used to design an optimum structure for a polishing pad.

(3) The invention provides a desired polishing pad to enhance wafer surface planarization while polishing is performed.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A chemical-mechanical polishing pad, comprising:

a plurality of annular grooves; and a plurality of streamline grooves, each of the streamline grooves locating within a first reference line and a second reference line, and each of the streamline grooves being tangent to the first reference line at a center of the chemical-mechanical polishing pad, each of the streamline grooves and the second reference forming an original angle of attack, wherein the original angle of attack of each of the streamline grooves of a polishing pad are defined by a flow equation derived from a source flow and a vortex flow, which source flow and vortex flow are generated while a slurry flows on the polishing pad.

2. The chemical-mechanical polishing pad of claim 1, wherein the flow equation is:

$$\psi=m\cdot\theta+k\cdot ln(r),$$

where ψ is a streamline function, m is a intensity constant of source flow, k is a intensity constant of vortex flow, ln is a natural logarithm, and r, θ, and z are coordinate parameters.

3. The chemical-mechanical polishing pad of claim 2, wherein a streamline groove function:

$$r=C_1\cdot e^{-m\theta/k}$$

according to the flow equation is obtained, where e is exponential, $C_1$ is a constant equal to $e^{\psi/k}$, and the streamline grooves are designed according to the streamline groove function.

4. The chemical-mechanical polishing pad of claim 1, where Navier-Stokes equations and boundary conditions are further adopted to obtain an angle and a height of the streamline groove.

5. The chemical-mechanical polishing pad of claim 4, wherein the Navier-Stokes equations are:

$$u\frac{\partial u}{\partial r}-\frac{v^2}{r}+w\frac{\partial u}{\partial z}=-\frac{1}{\rho}\frac{\partial P}{\partial r}+v\left[\frac{\partial^2 u}{\partial r^2}+\frac{\partial}{\partial r}\left(\frac{u}{r}\right)+\frac{\partial^2 u}{\partial z^2}\right],$$

-continued $$u\frac{\partial v}{\partial r}+\frac{uv}{r}+w\frac{\partial v}{\partial z}=v\left[\frac{\partial^2 v}{\partial r^2}+\frac{\partial}{\partial r}\left(\frac{v}{r}\right)+\frac{\partial^2 v}{\partial z^2}\right],\text{ and}$$

$$u\frac{\partial w}{\partial r}+w\frac{\partial w}{\partial z}=-\frac{1}{\rho}\frac{\partial P}{\partial z}+v\left[\frac{\partial^2 w}{\partial r^2}+\frac{1}{r}\left(\frac{\partial w}{\partial r}\right)+\frac{\partial^2 w}{\partial z^2}\right],$$

where u, v and w are respectively velocity for the r, θ and z components, ρ is density of the slurry, ν is dynamic viscosity, p is pressure, and r and z are coordinate parameters.

6. The chemical-mechanical polishing pad of claim 5, wherein boundary conditions are:

$$z=0,\ u=0,\ v=-\omega r,\ w=0;\text{ and}$$

$$z=\infty,\ u=0,\ v=0,$$

where ω is angular velocity of slurry.

7. The chemical-mechanical polishing pad of claim 6, wherein an equation for the original angle of attack of each of the streamline grooves is:

$$\tan\phi_0=-\left(\frac{\frac{\partial u}{\partial z}}{\frac{\partial v}{\partial z}}\right)_{z=0}=-\frac{F'(0)}{G'(0)}$$

where $\phi_0$ is an original angle of attack of the streamline groove, so that the following equations:

$$\xi=z/\delta=z\sqrt{\frac{\omega}{\nu}},$$

-continued $$u=\omega\cdot r\cdot F(\xi),\ v=\omega\cdot r\cdot G(\xi),\ w=\sqrt{\omega\cdot\nu}\cdot H(\xi),\text{ and}$$

$$P=\rho\cdot\nu\cdot\omega\cdot P(\xi),$$

where δ is fluid layer thickness of the slurry, are applied for variable transformation to obtain a variable transformation function of F and G.

8. The chemical-mechanical polishing pad of claim 7, wherein boundary conditions are:

$$\xi=0,\ F=0,\ G=-1,\ H=0,\ P=0;\text{ and}$$

$$\xi=\infty,\ F=0,\ G=0.$$

9. A chemical-mechanical polishing pad, comprising:

a plurality of annular grooves; and a plurality of streamline grooves, wherein each of the streamline grooves locating within a first reference line and a second reference line, and each of the streamline grooves being tangent to the first reference line at a center of the chemical-mechanical polishing pad, each of the streamline grooves and the second reference forming an original angle of attack, and the first and the second reference lines are radial directions from the center of the chemical-mechanical polishing pad.

10. The chemical-mechanical polishing pad of claim 9, wherein the streamline grooves are designed by a flow equation derived from a source flow and a vortex flow, and the source flow and the vortex flow are generated while a slurry flows on the polishing pad.

* * * * *